United States Patent [19]

Jongewaard et al.

[11] Patent Number: 4,847,238

[45] Date of Patent: Jul. 11, 1989

[54] THERMAL DYE TRANSFER DYE DONOR CONSTRUCTION

[75] Inventors: Susan K. Jongewaard; Julia A. Sills, both of St. Paul, Minn.

[73] Assignee: Minnesota Mining and Manufacturing Company, St. Paul, Minn.

[21] Appl. No.: 235,236

[22] Filed: Aug. 23, 1988

[51] Int. Cl.[4] ..... B41M 5/035

[52] U.S. Cl. ..... 503/227; 8/471; 428/195; 428/522; 428/913; 428/914

[58] Field of Search ..... 8/471; 428/195, 480, 428/522, 913, 914, 337; 503/227

[56] References Cited

U.S. PATENT DOCUMENTS

| | | | |
|---|---|---|---|
| 3,584,576 | 6/1971 | Kubo et al. | 101/128.2 |
| 3,736,133 | 5/1973 | Weigl et al. | 96/1.5 |
| 4,503,095 | 3/1985 | Seto et al. | 427/265 |
| 4,572,684 | 2/1986 | Sato et al. | 400/240.4 |
| 4,651,177 | 3/1987 | Morishita et al. | 346/227 |

FOREIGN PATENT DOCUMENTS

| | | | |
|---|---|---|---|
| 49-21602 | 6/1974 | Japan | 503/227 |
| 0286199 | 12/1986 | Japan | 503/227 |

*Primary Examiner*—Bruce H. Hess

*Attorney, Agent, or Firm*—Donald M. Sell; Walter N. Kirn; Mark A. Litman

[57] ABSTRACT

This invention relates to dye donor and dye receiving elements utilized in thermal dye transfer, and in particular to the use of chlorinated polyvinyl chloride, polyvinyl chloride or mixtures thereof as a polymeric material in a dye donor construction.

20 Claims, No Drawings

THERMAL DYE TRANSFER DYE DONOR CONSTRUCTION

FIELD OF THE INVENTION

This patent relates to a novel use of a defined class of polymeric resins to be used in a dye donor and dye image receptor assembly.

BACKGROUND OF THE INVENTION

Various resin systems are known to be related to use in thermal transfer systems. Polyvinyl chloride is one such resin. The use of polyvinyl chloride (PVC) in an image receptor layer or sheet is well known. It has been used typically in dye sublimation transfer systems, and also in thermal mass transfer systems. It is often disclosed as one of several resins workable in dye image receptors. No disclosures have discussed the use of PVC as the resin system for a dye donor construction.

Receptor substrates normally have surface modifying treatments to alter opacity, smoothness, adhesion of subsequent coatings, and tint and dye adsorption. When used as a coating, PVC typically is used with an additional resin, and most always with a plasticizer. Examples of the use of PVC as a receptor in thermal dye transfer applications are EP 227091, EP 228066, EP 133011, EP 133012, and EP 22806.

PVC can be used alone, or can be compounded with additional resins for desired properties. PVC is normally a rigid resin. To alter the physical properties of the polymer, low molecular weight substances called plasticizers are often added to the polymer formulation.

Chlorinated polyvinyl chloride (CPVC) is a modified monomer resin. CPVC is a homo-polymer of polyvinyl chloride that has been subjected to a chlorination reaction which replaces hydrogen atoms in PVC with chlorine atoms. CPVC has many of the desirable physical properties of PVC and retains them at significantly higher temperatures. The use of chlorinated polyvinyl chloride in thermal dye transfer, or even a thermal mass transfer application is novel.

U.S. Pat. No. 3,584,576 describes a heat sensitive stencil sheet comprising a film adhered to a porous thin fibrous sheet. The stencil sheet is perforated by exposure to infrared rays. The film consists essentially of at least 75% by weight of a chlorinated polyvinylchloride resin, the balance being a polyvinyl chloride resin. A colorant may also be present in the film. Upon being heated by infrared radiation, the film melts and forms perforations. The pores in the remaining fibrous sheet enable stencilling to be done through the perforations and the sheet.

SUMMARY OF THE INVENTION

Chlorinated polyvinyl-chloride (CPVC) and/or polyvinyl-chloride (PVC) are used as the principal resin in a thermal dye donor layer. This resin has been shown to have exceptional properties which distinguish it from other resins conventionally used in commercially available thermal dye transfer systems.

DETAILED DESCRIPTION OF THE INVENTION

In thermal dye transfer systems, different resins are typically used in the dye donor layer and the image receiving layer. Many systems have been described in the patent literature, but disclosure of the same resin used in a dye donor and a dye image receptor has not been found. For this reason, the use of chlorinated polyvinyl chloride resins and/or polyvinyl chloride in both the dye donor layer and the image receptor layer is novel. This patent will also describe the use of said resins in a dye donor sheet construction.

The use of polyvinyl chloride in the image receptor layer or image receptor sheet is well known. It has been used typically in dye sublimation transfer systems, and also thermal mass transfer systems. It is often disclosed as one of several resins workable in the dye image receptor. PVC can be used as the receptor sheet substrate for dye transfer, but also as a coated resin on a substrate. In use as a receptor substrate, it is normal for the PVC to have surface modifying treatments to alter opacity, smoothness, adhesion of subsequent coatings, tint and dye adsorption. When used as a coating, PVC typically is used with an additional resin, and almost always with a plasticizer.

CPVC has similar physical properties to PVC and retains them at significantly higher temperatures. CPVC is a PVC homopolymer that has been subjected to a chlorination reaction which increases the bound chlorine content of the polymer. Typically chlorine and PVC react according to a basic free radical mechanism. This can be brought about by various techniques using thermal and/or UV energy for initiation of the reaction. A generalized mechanism for the free radical chlorination of PVC can be shown as follows, wherein "R" stands for PVC:

| | Heat |
|---|---|
| Initiation | $Cl_2$ + UV energy → 2 Cl |
| Propagation | RH + Cl → R + HCl |
| | R + $Cl_2$ → RCl + Cl |
| Termination | R + Cl → RCl |
| | Cl + Cl → $Cl_2$ |
| | R + R → $R_2$ |

CPVC produced by such a mechanism can be quite varied in its possible structures depending on the chlorination method, conditions, and the amount of chlorine. The chlorine content of the starting PVC resin can be increased from 56 percent to as much as 74 percent, although most generally commercially available CPVC resins contain 62–74 percent chlorine. As the chlorine content in CPVC is increased, the glass transisition temperature (Tg) increases significantly. Also, as the molecular weight of the starting PVC is increased, there is a smaller proportional increase in the Tg at an equivalent level of chlorine. As the chlorine content goes from 56.8 to 63.5 percent, the Tg's for three typical CPVC polymers are 85, 108, and 128° C., respectively.

The following table illustrates common properties of commercially available PVC and CPVC resins (Table 1).

TABLE 1

| | PVC Homopolymer | CPVC Polymer | CPVC Polymer | CPVC Polymer | CPVC Polymer | Fully Chlorinated PVC | Fully Chlorinated PVC |
|---|---|---|---|---|---|---|---|
| Chlorine content (wt. %) | 56.8 | 62.5 | 67 | 67 | 67 | 69.8 | 70 |
| Density (g cm-3) | 1.40 | 1.50 | 1.56 | 1.56 | 1.56 | 1.57 | 1.57 |
| Tg (°C.) | 80–84 | 105 | 139 | 130 | 134 | 153 | 158 |
| Heat dis. | <114 | 114 | 145 | 144 | 148 | 156 | 166 |
| Inherent Viscosity | varies | 0.46 | 0.46 | 0.68 | 0.92 | 0.46 | 1.15 |

Ordinary polyvinylchloride resins decompose and turn black in color at temperatures at about 375° F. Chlorinated polyvinyl chloride resins exhibit a very high durability and a prolonged life and do not decompose at this temperature.

Two important differences in the properties of PVC and CPVC are in the higher glass transition temperature of CPVC (which aids in higher heat distortion properties) and in the respective ability of the resins to be softened by plasticizers. Better solubility of the resin for the dye aids in the achievement of higher concentrations of dye in the dye donor sheet, and also in the ability to transfer the dye more efficiently.

CPVC resins used in this invention have at least 57% by weight, preferably 62% by weight or more of recurring 1,2-dichloro-ethylene units in the resin.

Chlorinated polyvinyl resins used in the present invention are commercially available. Preferred resins are "Temprite" chlorinated polyvinyl chloride resins. Preferred polyvinyl chloride resins are "GEON" resins. CPVC and PVC both are available from B.F. Goodrich, Cleveland, Ohio. The commercially available CPVC resins vary in chlorine content from 62% to 74%. Such resin compositions are disclosed in U.S. Pat. No. 4,677,164.

The present invention describes a composition relating to thermal transfer printing, especially to the transfer donor sheet carrying a dye or dye mixture, and to a transfer printing process in which the dye is transferred from the donor sheet to a receptor sheet by the application of heat.

In the thermal transfer printing of the present invention, one or more heat transferable dyes are applied to a substrate. The substrate is then placed in contact with an image receiving sheet, and selectively heated in accordance with a pattern information signal whereby the dye/dyes are transferred to the receptor sheet. A pattern is formed on the receptor sheet in the shape and density generated in response to the electrical signal and the resulting intensity of heat applied to the donor sheet.

The heat transfer of the dye allows formation of a dye image having high color purity. The process is dry and takes only 2–20 msecs./line or less to give a color image. The process may be used to achieve a multi-color image either by sequentially transferring dyes from separate donor elements or by utilizing a donor element having two or more colors sequentially arranged on a continuous web or ribbon-like configuration. The colors may include yellow, magenta, cyan, and also black.

To hold sufficient dye in the donor sheet, and thereby to achieve the potential for a high density transfer of the dye to the receptor sheet, it is essential that (1) the dye is readily soluble or dispersible in the donor sheet medium, (2) the dye concentration is maintained in the dye donor sheet at the highest possible percentage, (3) the dye donor construction has a prolonged shelflife potential, and (4) the dye demonstrates a high degree of transfer efficiency to the dye receptor sheet.

It is highly desirable to have heat transferable dyes that are readily dispersed as solids or dissolved in the donor medium in order to prevent the dye crystal size from becoming large enough to adversely affect shelflife and transferability.

To help elucidate the advantage of using a chlorinated polyvinyl chloride or polyvinyl chloride resin as the binder in the dye donor construction over other commonly used binders such as cellulose derivatives, polyvinyl butyrals, and co-polymers such as styrene acrylonitrile, etc., a test was devised to quantify the desired resin system. A test for light transmission differences through a donor film is one such method of testing various donor constructions.

Light transmission through the donor film can be measured by a transparency index measurement. Transparency index measurements are made by using a densitometer. The densitometer is used as the measuring instrument for convenience of use and possession of an acceptable optical scheme. Measurements are made by using the densitometer filter (between the photocell and the sample) having the lowest adsorption value for the specific color being measured.

High image density readings indicate less back scattering of light and are interpreted as an indication of high transparency and higher dispersion of the dye in the donor sheet medium. Low image density readings, of 2.25 or lower, generally are associated with larger dye crystals in the donor construction leading to poor shelf-life, and poorer dye image transfer.

It is also desirable to have the dye dispersed or dissolved in the donor medium at high concentrations which at the time of transfer will yield high dye image densities. A means of measuring the efficiency of the dye is by means of a test for transfer efficiency of the dye. Dye transfer efficiency is related to the amount of dye available for transfer from the dye donor sheet to the dye receptor sheet, and the amount of dye received from the dye donor layer onto the dye receptor as a result of the transfer process. A calculated measure of the dye transfer efficiency is done by measuring (1) the initial reflective optical density of the coated donor sheet prior to thermal transfer printing (IROD), and (2) the reflective optical density of the transferred image on the receptor sheet (TROD). The quotient of TROD/IROD$\times$100 gives a measure of the transfer efficiency.

Transfer efficiency is dependent upon interactions of the donor sheet and the receptor sheet. Generally, different resin systems are used in commercial thermal dye transfer constructions for this purpose. Various resins systems have been proposed which include cellulose derivatives, vinyl butyrals, polycarbonates, polyesters, silicones and mixtures thereof. The various resins discussed are each specific to a desired property. The property of providing improved dye transfer densities is generally the most desirable, and this can be accomplished through high transfer efficiency of the dye from the donor sheet to the dye receptor sheet through the use of specific resin binders.

Problems with the presently known donor resin systems are poor shelf-life with the dye in the donor sheet. Blooming, or movement of the dye out of the resin system, can be caused by solubility properties of the dye in the resin. Bleeding of the dye can occur when the dye transfers from one material onto another material caused by some other additive which carries the dye out of the resin layer.

According to the present invention it has been found that a chlorinated polyvinyl chloride (CPVC) resin, PVC, and/or a combination of CPVC with a polyvinyl chloride resin substantially aids in the effective transfer of a heat transferable dye in thermal transfer process. These resins promote dye solubility and provide smaller dye crystal sizes.

Although polyvinyl chloride is well known as a resin used in thermal transfer systems, it is commonly used in a thermal receptor sheet as mentioned in patents such as in EP 133011, EP 133012, and many other patents. To our knowledge it has not been disclosed as a functional resin for a dye donor sheet. CPVC, PVC and combinations thereof have shown surprisingly high dye transfer efficiencies and good donor shelf life stabilities. These resins have high dye loading capability, as indicated in tests of transparency index measurements.

In the practice of the present invention, a dye donor sheet is made which comprises a support having a dye layer comprised of dye dispersed in a binder of CPVC and/or PVC. The chlorine content of the chlorinated polyvinyl chloride resin or polyvinyl chloride resin of the present invention is from 56–74% by weight of the polymer, and most preferrably 56% to 67% by weight of the polymer. The inherent viscosity of the CPVC of the present invention is generally from 0.4 to 1.5 and preferably from 0.46–1.15. The glass transition of the CPVC and/or PVC is from 80° C. to 160° C.

The chlorinated polyvinyl chloride and resins of the present invention is used in a concentration which will provide an effective dye donor element. In a typical embodiment of the present invention, an amount of 10% to 80% by weight is used for the donor composition, preferably in the amount of 30% to 70% by weight.

In another preferred emodiment of the present invention, an additional resin may be used in the makeup of the present invention. Additional resins are typically hydrophobic in nature, which include phenoxy resins such as PKHH (a bisphenol A polymer available from Union Carbide), polyhydroxyethers, cellulose derivatives, cellulose acetates, cellulose acetate butyrates, cellulose actetate proprionates, polyesters, vinyl compounds such as vinyl acetates, vinylbutyrals, vinyl chlorides, small amounts of polyvinyl alcohol, acrylates such as methylmethacrylate, acrylonitrile, and styrene. These resins maybe used in any combination, generally in the amount of up to 50% by weight, e.g., 1% to 50% by weight, preferably 1% to 30% by weight of the composition. These additional polymeric components may be added as blends or the units copolymerized with the chlorinated polyvinyl chloride and/or the vinyl chloride. Both the PVC and CPVC resins may be copolymers.

Any dye which satisfies the following requirements can be used in the construction of the present inveniton. These requirements are that the dye/dyes be transferable by heat to the dye recieving layer. The heat transferred dyes are soluble or intimately dispersible within the polymeric coating of the dye donor sheet. Preferred dyes are azo, indoanaline, anthraquinone, amino styryl, tricyanostryl, thiazine, diazine and oxazine. Typically the molecular weight range is from 100 to 800.

The ratio of dye to binder is preferably from 30:70 to 80:20 to provide high density transfer, good adhesion between the dye and substrate, and to inhibit migration of the dye during storage.

The dye door construction may also contain additives to help stabilize and solubilize the dye. The additives can be added in concentrations from 0.1% of the total dye concentration to 20% by weight. Such additives include polyurethanes, plasticizers, UV stabilizers, heat stabilizers, surfactants, silicones, low Tg polymers (Tg below or equal to 80° C.) and elastomers.

The dye donor layer is usually coated out of an organic solvent. Suitable solvents are THF, MEK, and mixture thereof, MEK/toluene blends, and THF/chlorinated solvent blends.

Suitable substrates for the donor for use in the present invention include substrates that are smooth, transparent or opaque, continuous, and non-porous. It may be of natural or synthetic polymeric resin (thermoplastic or thermoset). For the most commercial purposes the substrate is preferably a polymeric resin such as polyester (e.g. polyethyleneterephthalate, which may be biaxially oriented and dimensionally stabilized), polyethylene napthalate, polysulfones, polycarbonate, polyimide, polyamide, cellulose papers. The support generally has a thickness of less than 15 microns, usually between 1–12 microns, with less than 6 microns preferred.

By "non-porous" in the description of the present invention it is meant that inks, paints and other liquid coloring media will not readily flow through the substrate (e.g., less than 0.05 cc/sec at 7 mm Hg pressure, preferably less than 0.02 cc/sec at 7 mm Hg pressure). The lack of significant porosity prevents absorption of the heated transfer layer into the substrate and prevents uneven heating through the backing layer. The backing sheets of U.S. Pat. No. 3,584,576 which are required to be porous in order for the stencil to work, although described as thin, are shown to be about four times greater in thickness (48 microns) than the maximum thickness of backing sheets in the present invention.

Some donor sheets preferably comprise, in addition to the substrate a backside coating of a heat resistant material such as a silicone or a polyurethane, higher fatty acids, fluorocarbon resin, etc., to prevent the substrate from sticking to the thermal head.

The dye donor elements of the present invention may be used in a sheet size embodiment or in a continuous roll form such as a continuous web or ribbon. If a continous ribbon or roll is used it may have one or several color coatings on the surface of the support. The dye layer may be coated in a continuous layer or can be sequentially arranged colors. Dyes used in the lateral arrangement are usually yellow, cyan, and magenta, and sometimes black, but not necessarily limited to these colors as such. The construction is coated in sequentially arranged colors as to provide a three color dye transferred image. The dye layer may be coated or printed on a suitable sized substrate by conventionally known techniques such as extrusion, rotogravure, etc.

The following examples are provided to illustrate the invention.

TRANSPARENCY INDEX DATA FOR DYE DONOR SHEETS

A simple test was constructed to help indicate the advantages of CPVC or PVC over other binders such as cellulose derivatives, polyvinyl butyral resins, and co-polymers of vinylidene chloride and acrylonitrile, which are commonly mentioned in patent literature. Six commercially available dyes 1–6 (dimethyl magenta [4-tricyanovinyl-N,N-dimethylaniline], methyl yellow, waxoline blue, dibutyl magenta [4-tricyanovinyl-N,N-dibutylaniline], Sudan yellow, and 2-chloro-2'-methyl-N,n-diethylindoaniline) and six polymers, Temprite® 678×512, Geon® 178 (B. F. Goodrich), CAB TM 272-20 (Kodak), CA TM 398-3 (Kodak), Butvar® B-74 (Monsanto), and Saran® F310 (Dow Chemical Co.) were selected. Solutions of the dye and resins were prepared in which the ratio of dye to resin varied from 40 to 80 percent by weight of solution. The solutions were coated onto 6 micron Teijin F24G thermal transfer film using a #8 Meyer bar to a wet thickness of 0.72 mils (0.018 mm). The coatings were air dried, and transparency and haze readings were taken on each sample using the transparency index test method described previously. From the results, in all cases, the use of CPVC and PVC allowed higher levels of dye to be incorporated into the film without observing dye crystallization. Once the coated film becomes highly crystalline or hazy, the dye transfer properties and dye stability become very poor.

Comparisons of CPVC, PVC and mixtures thereof to polyvinyl butyral, cellulose acetate butyrate, cellulose acetate, and polyvinylidene chloride showed the resins of the present invention to be far superior to the other resins. The transparency of the comparative resins consistently tended to drop lower than the transparency with CPVC, PVC and their combinations. There was considerable variation in the transparency (and solubility) of dyes in the comparative binders, with PVC, CPVC and their combinations being much more consistent in these performance characteristics.

Table of Dyes to be used in the present invention of the dye donor sheet

| Dye | Name |
|---|---|
| 1 | Sudan Yellow |
| 2 | Color-in-Color Cyan(2-chloro-2'-methyl-N,n-diethylindoaniline) |

Table of Resins used in the dye donor construction

| Binder | Commercial Name | CPVC | PVC | Chlorine Content |
|---|---|---|---|---|
| 1 | Geon 178 | | X | |
| 2 | Temprite 678 × 512 | X | | 62.5 |
| 3 | Temprite 627 × 563 | X | | 67.0 |

Table of Additives used in dye donor sheet constructions

| Additive | Composition | Source |
|---|---|---|
| EPON ® 1002 | Epoxy Resin | Shell Chem. Co. |
| VITEL ® PE 200 | Vitel polyester | Goodyear |
| FERRO ® 1237 | Stabilizer | BASF |

-continued

Table of Additives used in dye donor sheet constructions

| Additive | Composition | Source |
|---|---|---|
| PLASTOLEIN ® 9776 | Polyester | Emery |
| UVINUL ® N539 | UV Stabilizer | BASF |
| TERGITOL ® TMN-10 | Surfactant | Rhom and Haas |
| FLUORAD ® FC 431 | Fluorocarbon | 3M |
| RD 1203 | 60/40 blend of octadecyl acrylate/acrylic acid | 3M |

DYE RECEPTOR CONSTRUCTIONS TO BE USED WITH THE DYE DONOR EXAMPLES

The following substances were mixed in the order as listed. The solution was coated onto a 2–4 mil transparent PET base film using a #8 wire bound Meyer bar to a wet thickness of 0.72 mil. Each coating was hot air dried for approximately 2 minutes. The finished size of the sheets varied. Typical size of the sheet used was 2–5 inches in width, while the length was matched to the dye donor sheet size used.

| Receptor Construction #1 | Amount in gm. |
|---|---|
| ICI 382 ES | 0.248 |
| Temprite ® 678 × 512 | 0.200 |
| EPON ® 1002 | 0.040 |
| VITEL ® PE 200 | 0.040 |
| FLUORAD ® FC 431 | 0.050 |
| TINUVIN ® 328 | 0.015 |
| UVINUL ® N539 | 0.050 |
| FERRO ® 1237 | 0.050 |
| THF | 4.560 |
| MEK | 1.850 |

RECEPTOR CONSTRUCTION #2

The receptor is a white filled polyester film base with a silicone crosslinked backside coating.

DYE DONOR CONSTRUCTIONS

Dye donor sheets were made by coating the dye/-binder solution onto 5.7 micron Teijin F24G thermal film (available from Teijin) by using #8 wire bound Meyer-bar to a wet thickness of 0.72 mils (0.018 mm), then air dried.

| Example | Amount in gm. |
|---|---|
| 1 Dye 1 | 0.06 |
| Binder 1 | 0.03 |
| THF | 2.41 |
| 2 Dye 1 | 0.06 |
| Binder 2 | 0.03 |
| THF | 2.41 |
| 3 Dye 1 | 0.06 |
| Binder 3 | 0.03 |
| THF | 2.41 |
| 4 Dye 2 | 0.06 |
| Binder 1 | 0.03 |
| THF | 2.41 |
| 5 Dye 2 | 0.06 |
| Binder 2 | 0.03 |
| THF | 2.41 |
| 6 Dye 2 | 0.06 |
| Binder 3 | 0.03 |
| THF | 2.41 |
| 7 Dye 1 | 0.06 |
| Binder 1 | 0.03 |
| RD 1203 | 0.01 |
| THF | 2.41 |
| MEK | 0.14 |

-continued

| Example | | Amount in gm. |
|---|---|---|
| 8 | Dye 2 | 0.06 |
| | Binder 1 | 0.03 |
| | RD 1203 | 0.01 |
| | THF | 2.41 |
| | MEK | 0.14 |
| 9 | Dye 1 | 0.06 |
| | Binder 2 | 0.03 |
| | RD 1203 | 0.01 |
| | THF | 2.41 |
| | MEK | 0.14 |
| 10 | Dye 2 | 0.06 |
| | Binder 2 | 0.03 |
| | RD 1203 | 0.01 |
| | THF | 2.41 |
| | MEK | 0.14 |
| 11 | Dye 1 | 0.06 |
| | Binder 3 | 0.03 |
| | Rd 1203 | 0.01 |
| | THF | 2.41 |
| | MEK | 0.14 |
| 12 | Dye 2 | 0.06 |
| | Binder 3 | 0.03 |
| | RD 1203 | 0.01 |
| | THF | 2.41 |
| | MEK | 0.14 |
| 13 | Dye 2 | 0.060 |
| | Binder 2 | 0.030 |
| | Ferro ® 1237 | 0.015 |
| | THF | 2.410 |
| | MEK | 0.140 |
| 14 | Dye 2 | |
| | Binder 2 | 0.060 |
| | Plastolein ® 9776 | 0.030 |
| | THF | 2.410 |
| | MEK | 0.140 |
| 15 | Dye 2 | 0.060 |
| | Binder 1 | 0.015 |
| | Binder 2 | 0.015 |
| | RD 1203 | 0.010 |
| | THF | 2.410 |
| | MEK | 0.140 |
| 16 | Dye 2 | 0.060 |
| | Binder 1 | 0.015 |
| | Binder 3 | 0.015 |
| | RD 1203 | 0.010 |
| | THF | 2.410 |
| | MEK | 0.140 |

Dye donor and dye receptor sheet were assembled and imaged with a Kyocera KMT thermal print head with a burn time of 4–7 miliseconds at 13.5 volts, and burn profile of 70/40 (70 milliseconds on, 40 milliseconds off). Example 5 was used with dye receptor #2, all of the other examples were used with dye receptor #1. Levels of gradation were recorded, as well as IROD, TROD, and transfer efficiencies. Experimental results are recorded below.

Experimental Results for Dye Donors 1–12

| Example No. | Resin Binder | IROD | TROD | Transfer Efficiency | Grey Levels |
|---|---|---|---|---|---|
| 1 | PVC | 1.59 | 1.28 | 81 | Yes |
| 2 | CPVC | 1.19 | 0.83 | 70 | Yes |
| 3 | CPVC | 1.44 | 1.02 | 71 | Yes |
| 4 | PVC | 2.53 | 2.20 | 87 | Yes |
| 5 | CPVC | 1.19 | 0.83 | 70 | Yes |
| 6 | CPVC | 1.80 | 1.21 | 67 | Yes |
| 7 | PVC | 1.61 | 1.45 | 90 | Yes |
| 8 | PVC | 2.61 | 2.35 | 90 | Yes |
| 9 | CPVC | 1.25 | 1.09 | 87 | Yes |
| 10 | CPVC | 2.39 | 2.20 | 92 | Yes |
| 11 | CPVC | 1.58 | 1.12 | 71 | Yes |
| 12 | CPVC | 1.64 | 1.22 | 74 | YES |
| 13 | CPVC | 2.51 | 2.25 | 90 | YES |
| 14 | CPVC | 2.52 | 2.32 | 92 | Yes |

-continued

Experimental Results for Dye Donors 1–12

| Example No. | Resin Binder | IROD | TROD | Transfer Efficiency | Grey Levels |
|---|---|---|---|---|---|
| 15 | PVC/CPVC | 2.46 | 22.31 | 94 | Yes |
| 16 | PVC/CPVC | 2.54 | 2.36 | 93 | Yes |

It is well known in the art to add protective layers or other auxiliary layers over the receptor layer of the receptor element or over the donor layer of the donor element.

As noted above, commercially available CPVC has from about 62 to 74% by weight chlorine in the polymer chain. PVC itself has about 56% chlorine by weight. It is therefore possible to partially chlorinate PVC so that its chlorine content could be above 56% and below 62% by weight. The only reason that this is not as desirable is the inconvenience in obtaining chlorination levels which are not commercially available. There is no functional necessity in the selection of the CPVC that requires greater than 62% although the glass transition temperature does tend to increase with increasing levels of chlorination.

What is claimed is:

1. A dye donor sheet for transferring dye donor material in an imagewise manner by means of thermal dye transfer printing, said sheet comprising a non-porous backing material having on at least one major surface thereof a thermal dye transfer layer comprising a dye in a chlorinated polyvinyl chloride resin or a mixure of chlorinated polyvinyl chloride and polyvinyl chloride resin.

2. The sheet of claim 1 wherein said layer comprises from 10% to 80% by weight of resin selected from the group consisting of chlorinated polyvinyl chloride, and a mixture of polyvinyl chloride and chlorinated polyvinyl chloride, and said chlorinated polyvinyl chloride resin having a chlorine content of between 62–74% chlorine.

3. The sheet of claim 2 wherein said resin comprises 30% to 70% by weight of the dye donor layer.

4. The sheet of claim 3 wherein said resin consists essentially of chlorinated polyvinyl chloride.

5. The sheet of claim 2 wherein said resin comprises chlorinated polyvinyl chloride as the principal resin in said layer.

6. The sheet of claim 1 wherein a thermally transferable dye is present in the donor layer in the range of 30:70 to 80:20 of dye to binder in the dye donor layer.

7. The sheet of claim 6 wherein said resin consists essentially of chlorinated polyvinyl chloride.

8. The sheet of claim 1 wherein said resin consists essentially of chlorinated polyvinyl chloride.

9. A dye donor sheet for transferring dye donor material in an imagewise manner by means of thermal dye transfer printing, said sheet comprising a backing layer of a thickness of less than 15 microns having on at least one major surface thereof a thermal dye transfer layer comprising a dye in a chlorinated polyvinyl chloride resin, or a mixed chlorinated polyvinyl chloride and polyvinyl chloride resin material, said chlorinated polyvinyl chloride resin having a chlorine content of between 62–74% chlorine, and an inherent viscosity of from 0.46 to 1.15.

10. The sheet of claim 9 wherein said layer comprises from 10% to 80% by weight of a resin selected from the group consisting of chlorinated polyvinyl chloride, and mixtures of chlorinated polyvinyl chloride and polyvinyl chloride.

11. The sheet of claim 10 wherein said resin comprises 30% to 70% by weight of the dye donor layer.

12. The sheet of claim 11 wherein said resin consists essentially of chlorinated polyvinyl chloride.

13. The sheet of claim 9 wherein a thermally transferable dye is present in the donor layer in the range of 30:70 to 80:20 of dye to binder in the dye donor layer.

14. The sheet of claim 13 wherein said resin consists essentially of chlorinated polyvinyl chloride.

15. The sheet of claim 9 wherein said resin consists essentially of chlorinated polyvinyl chloride.

16. A dye donor sheet for transferring dye donor material in an imagewise manner by means of thermal dye transfer printing, said sheet comprising a non-porous backing layer having a thickness of between 1 and 12 microns and having on at least one major surface thereof a transparent thermal dye transfer layer comprising a dye in a chlorinated polyvinyl chloride resin, or a mixed chlorinated polyvinyl chloride resin and polyvinyl chloride resin material, said chlorinated polyvinyl chloride resin having a chlorine content of between 62–74% chlorine.

17. The sheet of claim 16 wherein said layer comprises from 10% to 80% by weight of resin selected from the group consisting of chlorinated polyvinyl chloride, and mixtures of chlorinated polyvinyl chloride and polyvinyl chloride.

18. The sheet of claim 17 wherein said resin comprises 30% to 70% by weight of the dye donor layer.

19. The sheet of claim 18 wherein said resin consists essentially of chlorinated polyvinyl chloride.

20. The sheet of claim 16 wherein a thermally transferable dye is present in the donor layer in the range of 30:70 to 80:20 of dye to binder in the dye donor layer.

* * * * *